US009239150B2

(12) United States Patent
Sieberth et al.

(10) Patent No.: US 9,239,150 B2
(45) Date of Patent: Jan. 19, 2016

(54) LINEAR LIGHTING DEVICE

(71) Applicant: Cree, Inc., Durham, NC (US)

(72) Inventors: Bernd Sieberth, Salem, WI (US); Steven Patkus, Mount Pleasant, WI (US); Brian Kinnune, Racine, WI (US)

(73) Assignee: Cree, Inc., Durham, NC (US)

( * ) Notice: Subject to any disclaimer, the term of this patent is extended or adjusted under 35 U.S.C. 154(b) by 13 days.

(21) Appl. No.: 13/842,012

(22) Filed: Mar. 15, 2013

(65) Prior Publication Data

US 2014/0268765 A1 Sep. 18, 2014

(51) Int. Cl.

| | |
|---|---|
| ***F21V 21/00*** | (2006.01) |
| ***F21S 4/00*** | (2006.01) |
| ***F21V 15/01*** | (2006.01) |
| ***F21V 29/507*** | (2015.01) |
| ***F21V 23/00*** | (2015.01) |
| ***F21V 29/503*** | (2015.01) |
| ***F21V 29/508*** | (2015.01) |
| *F21Y 101/02* | (2006.01) |
| *F21Y 103/00* | (2006.01) |

(52) U.S. Cl.

CPC ..... *F21V 15/01* (2013.01); *F21V 23/009* (2013.01); *F21V 29/503* (2015.01); *F21V 29/507* (2015.01); *F21V 29/508* (2015.01); *F21Y 2101/02* (2013.01); *F21Y 2103/003* (2013.01)

(58) Field of Classification Search

CPC ..... F21V 15/01; F21V 29/507; F21V 29/503; F21V 23/009; F21V 29/508; F21Y 2103/003; F21Y 2101/02

USPC ..... 362/221–225, 217.1–217.17, 362/249.01–249.02, 362, 368, 362/217.01–217.06

See application file for complete search history.

(56) References Cited

U.S. PATENT DOCUMENTS

| | | | | |
|---|---|---|---|---|
| D104,033 | S | 10/1936 | Kanter | |
| D117,301 | S | 10/1939 | Welch | |
| D150,745 | S | 8/1948 | Winkler et al. | |
| D158,803 | S | 5/1950 | Russell | |
| D203,060 | S | 11/1965 | Schaefer | |
| D231,942 | S | 6/1974 | Cincotta | |
| D238,296 | S | 12/1975 | Trimarchi | |
| D278,555 | S | 4/1985 | Cummings | |
| 4,580,200 | A * | 4/1986 | Hess et al. | 362/223 |
| 4,942,271 | A | 7/1990 | Corsi et al. | |
| D348,946 | S | 7/1994 | Watters et al. | |
| D400,899 | S | 11/1998 | Simms | |
| D421,815 | S | 3/2000 | Herst et al. | |
| D432,696 | S | 10/2000 | Ford | |
| 6,135,613 | A | 10/2000 | Bodell et al. | |
| 6,182,848 | B1 | 2/2001 | Wang | |
| 6,332,597 | B1 | 12/2001 | Korcz et al. | |
| 6,347,715 | B1 | 2/2002 | Drozdenko et al. | |

(Continued)

*Primary Examiner* — Donald Raleigh

(74) *Attorney, Agent, or Firm* — McCracken & Gillen LLC

(57) ABSTRACT

A linear lighting device includes a body, a light source holder, and a light source. The body has a top portion, a bottom portion, and a rear portion. The light source holder has a holding member and an attachment member. The attachment member of the light source holder is secured to the rear portion of the body. Further, the light source is disposed on the holding member of the light source holder. A lighting device also includes a cover. The cover has a first end and a second end, and is movable between an open position and a closed position. The first end of the cover is pivotably secured to the bottom portion of the body and the second end of the cover is adapted to be fixedly secured to the top portion of the body.

44 Claims, 8 Drawing Sheets

(56) References Cited

U.S. PATENT DOCUMENTS

| | | | | |
|---|---|---|---|---|
| 6,348,686 | B1 | 2/2002 | Howard et al. | |
| D457,498 | S | 5/2002 | Birnbaum | |
| 6,461,026 | B1 | 10/2002 | Wang | |
| 6,484,360 | B1 | 11/2002 | DeBartolo, Jr. et al. | |
| D468,473 | S | 1/2003 | Shemitz et al. | |
| 6,525,890 | B1 | 2/2003 | Wang et al. | |
| 6,796,676 | B2 | 9/2004 | Severtson et al. | |
| D523,165 | S | 6/2006 | Schultz | |
| 7,083,308 | B2 | 8/2006 | Kenyon et al. | |
| 7,147,348 | B2 | 12/2006 | Heaton et al. | |
| 7,175,312 | B2 | 2/2007 | Fowler, Jr. | |
| D543,305 | S | 5/2007 | Wang | |
| 7,252,415 | B2 | 8/2007 | Wang | |
| D550,885 | S | 9/2007 | Crosby | |
| D553,287 | S | 10/2007 | Miller | |
| D607,599 | S | 1/2010 | Zhou et al. | |
| 7,766,503 | B2 * | 8/2010 | Heiking et al. | 362/147 |
| D627,914 | S | 11/2010 | Couture | |
| D633,642 | S | 3/2011 | Wauters | |
| D635,290 | S | 3/2011 | Hsu et al. | |
| D637,338 | S | 5/2011 | Kong et al. | |
| 7,946,738 | B2 | 5/2011 | Fowler, Jr. et al. | |
| 7,976,193 | B2 | 7/2011 | Klein et al. | |
| D643,960 | S | 8/2011 | Waldmann | |
| D649,264 | S | 11/2011 | Brabeck et al. | |
| 8,070,314 | B2 | 12/2011 | St. Ives et al. | |
| 8,092,040 | B2 | 1/2012 | Wu et al. | |
| 8,142,048 | B2 | 3/2012 | Risley, Sr. | |
| D659,880 | S | 5/2012 | Maxik et al. | |
| D667,585 | S | 9/2012 | Yamazaki et al. | |
| D673,720 | S | 1/2013 | Bailey et al. | |
| 8,672,508 | B2 * | 3/2014 | Pearson et al. | 362/249.02 |
| 2008/0002399 | A1 * | 1/2008 | Villard et al. | 362/184 |
| 2010/0053947 | A1 * | 3/2010 | Fowler et al. | 362/223 |
| 2010/0271816 | A1 * | 10/2010 | Ozeki et al. | 362/217.05 |
| 2011/0141722 | A1 * | 6/2011 | Acampora et al. | 362/218 |
| 2012/0008329 | A1 * | 1/2012 | Wang | 362/372 |
| 2012/0087118 | A1 | 4/2012 | Bailey et al. | |

* cited by examiner

LINEAR LIGHTING DEVICE

BACKGROUND OF THE INVENTION

1. Field of the Invention

The present invention is related generally to a lighting device, and more particularly a wallwash lighting device.

2. Description of the Background of the Invention

A lighting device is generally used to illuminate a space such as a room or a surface such as a wall, a ceiling, architectural element, signage, artwork, and the like. A typical lighting device includes a fixture, one or more light sources disposed in the fixture, and driver electronics to control the light sources. Traditionally, lighting devices have used fluorescent or incandescent light sources. Some lighting devices use solid-state light emitters including organic, inorganic, and polymer light emitting diodes (LEDs) as an energy-efficient alternative to the traditional fluorescent or incandescent light sources.

The LEDs used in lighting devices are typically high-powered solid-state emitters to provide a desired level of brightness. Because the lifetime of an LED is inversely related to the operating junction temperature thereof, thermal management of the junction temperature is an important design consideration of a lighting device that includes LEDs. Such a lighting device typically incorporates structures to transport heat from the LED junction and the driver electronics to the environment outside the lighting device.

A lighting device typically encloses the light source, driver electronics to control the light source, and cabling between the driver electronics and the light source within a housing of the light fixture. Such a lighting device typically includes a moveable cover that allows access to the components inside the light fixture for repair and/or periodic maintenance.

SUMMARY OF THE INVENTION

According to one aspect of the present invention, a lighting device includes a body, a light source holder, and a light source. The body has a top portion, a bottom portion, and a rear portion. The light source holder has a holding member and an attachment member. The attachment member of the light source holder is secured to the rear portion of the body. Further, the light source is disposed on the holding member of the light source holder.

According to another aspect of the present invention a lighting device includes a body and a cover. The body has a top portion and a bottom portion. The cover has a first end and a second end and is movable between an open position and a closed position. The first end of the cover is pivotably secured to the bottom portion of the body and the second end of the cover is adapted to be fixedly secured to the top portion of the body.

Other aspects and advantages of the present invention will become apparent upon consideration of the following detailed description.

DETAILED DESCRIPTION OF THE PREFERRED EMBODIMENTS

Figure 1:
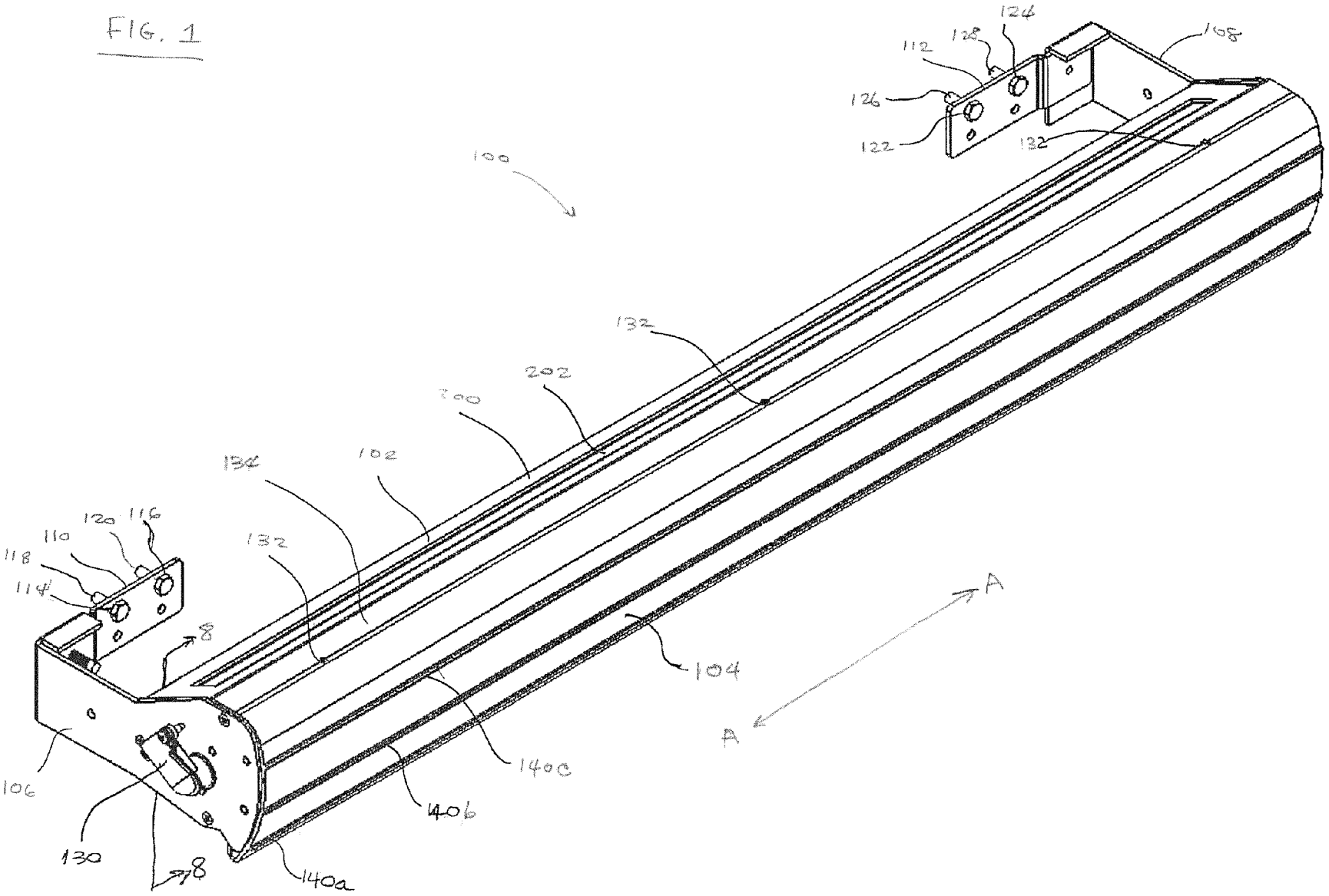
FIG. 1 is an isometric view of a lighting device from above.
Figure 2:
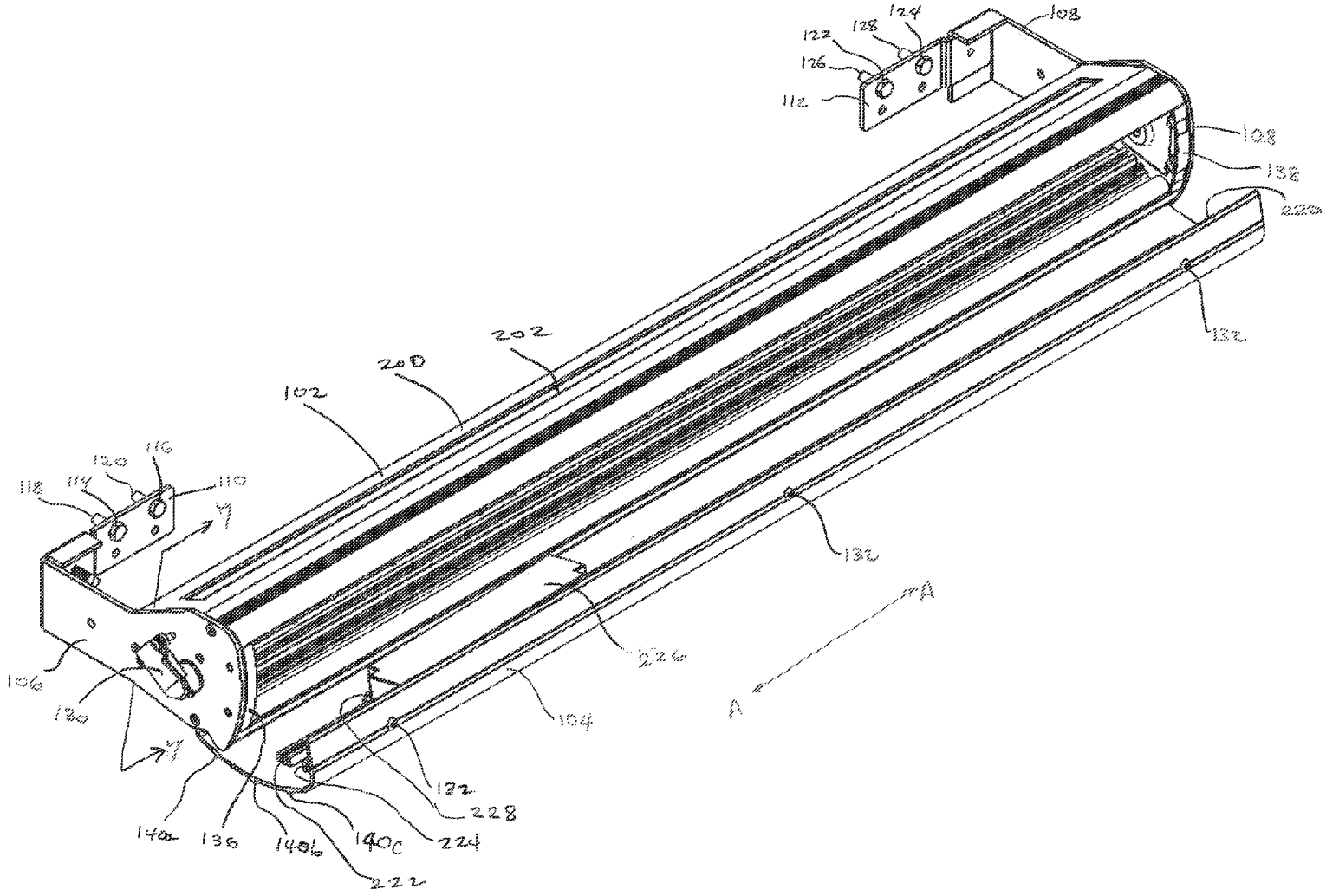
FIG. 2 is another isometric view of the lighting device system of FIG. 1.

FIGS. 1-8 illustrate an embodiment of a lighting device 100. Referring to FIGS. 1-8, the lighting device 100 includes a body 102, a cover 104, a left side plate 106, and a right side plate 108. It should be apparent that terms left and right (as well as other directional terms) are used herein to provide reference only and not to limit the embodiments described.

The left side plate 106 extends outwardly from the rear of the body 102 and includes a flange 110. The flange 110 extends towards the right from the left side plate 106. Similarly, the right side plate 108 extends outwardly from the rear of the body 102 and includes a flange 112. The flange 112 extends toward the left from the right side plate 108. The flanges 110 and 112 may be used to secure the lighting device 100 to a surface such as a wall, and the like. In particular, the flange 110 includes screw holes 114 and 116 through which screws 118 and 120, respectively, may be passed and secured to the surface. Similarly, the flange 112 includes screw holes 122 and 124 through which screws 126 and 128, respectively, may be passed and secured to the surface. It should be apparent that securing the flanges 110 and 112 to the surface in this manner secures the lighting device 100 to the surface. The flanges 110 and 112 may include fewer or more screw holes through which screws may be passed to affix the lighting device 100 to a surface. In addition, other ways of securing the lighting device 100 to the surface will be apparent to those who have skill in the art.

In some embodiments, the left side plate 106 may include a connector 130 that may be coupled to a conduit (not shown) that has a wire from a power source to supply electrical power to the lighting device 100. In other embodiments, the connector 130 may be disposed on the right side plate 108. In still other embodiments, such connectors 130 may be disposed on both the left side plate 106 and the right side plate 108. If the lighting device 100 is battery powered, the connector 130 may not be required.

Some embodiments of the lighting device 100 include screws 132 that secure a top portion 134 of the cover 104 to the body 102 when the cover 104 is in a closed position.

The body 102, cover 104, the left side plate 106, and right side plate 108 are typically constructed from a thermally conductive material such as aluminum or an aluminum alloy. It should be apparent that other thermally conductive materials may be used. Further, the body 102 and the cover 104 may be manufactured by extruding the thermally conductive material. Using a thermally conductive material facilitates the transfer of heat from inside the space formed by the body 102, cover 104, the left side plate 106, and the right side plate 108 to the exterior of the lighting device 100. In some embodiments, the left side plate 106 may include a wall 136 extending toward the right that provides support for the cover 104 when the cover 104 is in the closed position and also conducts heat between the left side plate 106 and the cover 104. Similarly, the right side plate 108 may include a wall 138 extending toward the left that provides support for the cover 104 and facilitates heat transfer.

In some embodiments, a sealing member (not shown), for example, a gasket may be secured to a surface of the left side plate 106 and/or the right side plate 108 to seal the interior of the lighting device from the environment. For example, such seal may prevent water from entering the interior. Such surface may be a surface facing toward the body 102 or away from the body 102. Further, a sealing member (not shown), for example, a strip gasket, may be adhered to one or more edges of the body 102 and/or the cover 104 to similarly seal the interior from the environment when the cover 104 is in a closed position. Such sealing members may be affixed to the left side plate 106, the right side plate 108, the body 102, and/or the cover 102 using, for example, an adhesive such as a pressure sensitive adhesive. Other ways of affixing such sealing members will be apparent to those who have skill in the art.

In some embodiments, the cover 104 may include one or more ribs 140 that protrude outwardly therefrom and extend along the direction A-A.

Figure 3:
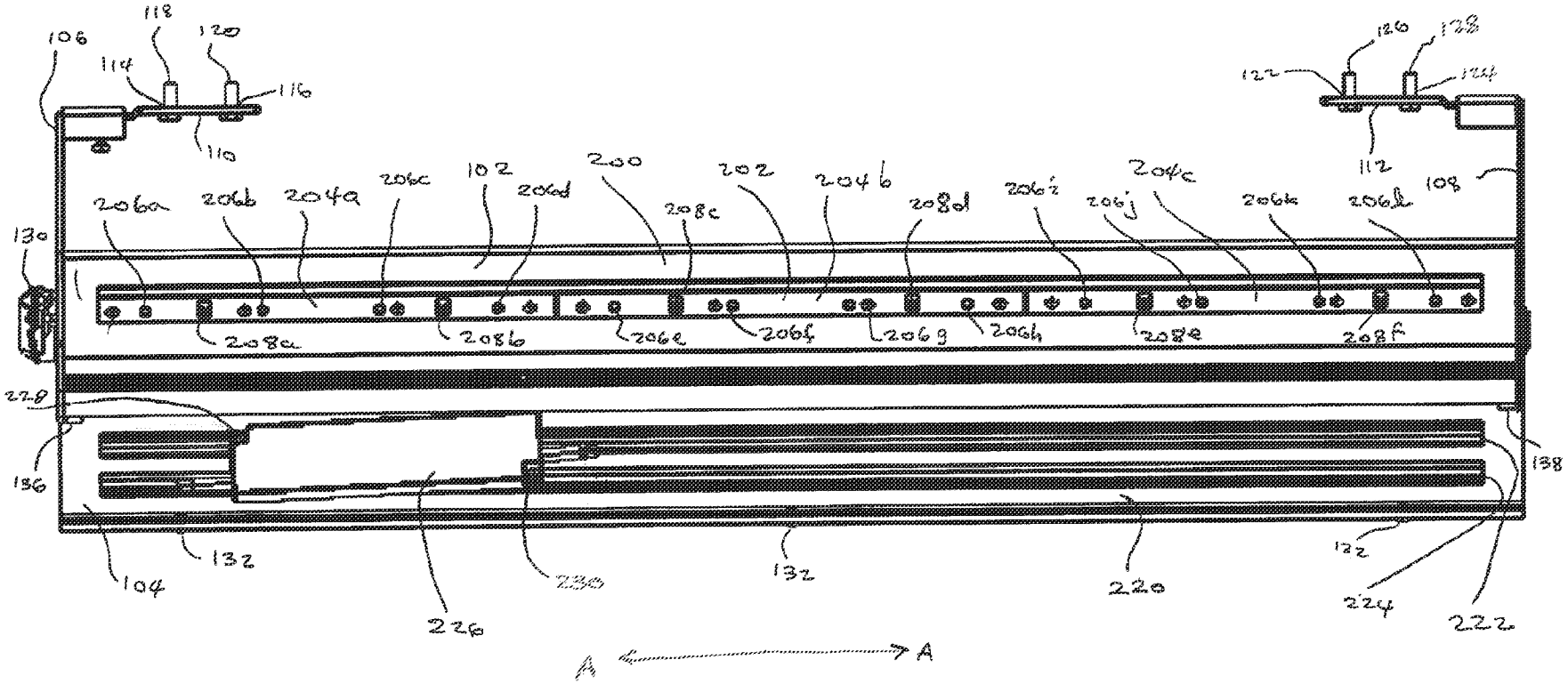
FIG. 3 is a top plan view of the lighting device of FIG. 1.

Disposed on a top portion 200 of the body 102 is a window 202 that partially extends the length of the body 102 in the direction A-A. A first set of circuit boards 204 having LED light sources 206 secured thereto are disposed inside the body 102 such that the light emitted by the LEDs is projected outwardly through the window 202. Further, although three circuit boards 204*a*, 204*b*, and 204*c* are shown in FIG. 3, it should be apparent that more or fewer circuit boards 204 may be disposed in the body 102. The circuit boards 204*a*, 204*b*, and 204*c* do not each have to have an identical quantity of LED light sources 206 disposed thereon. For example, the circuit boards 204*a* and 204*c* each have four LED light sources 206 disposed thereon and the circuit board 204*b* has six LED light sources 206 disposed thereon. Each circuit board 204 also has one or more terminal blocks 208 disposed thereon to distribute power from a driver unit (described below) to the LED light sources 206 disposed on such circuit board 204.

Figure 4B:
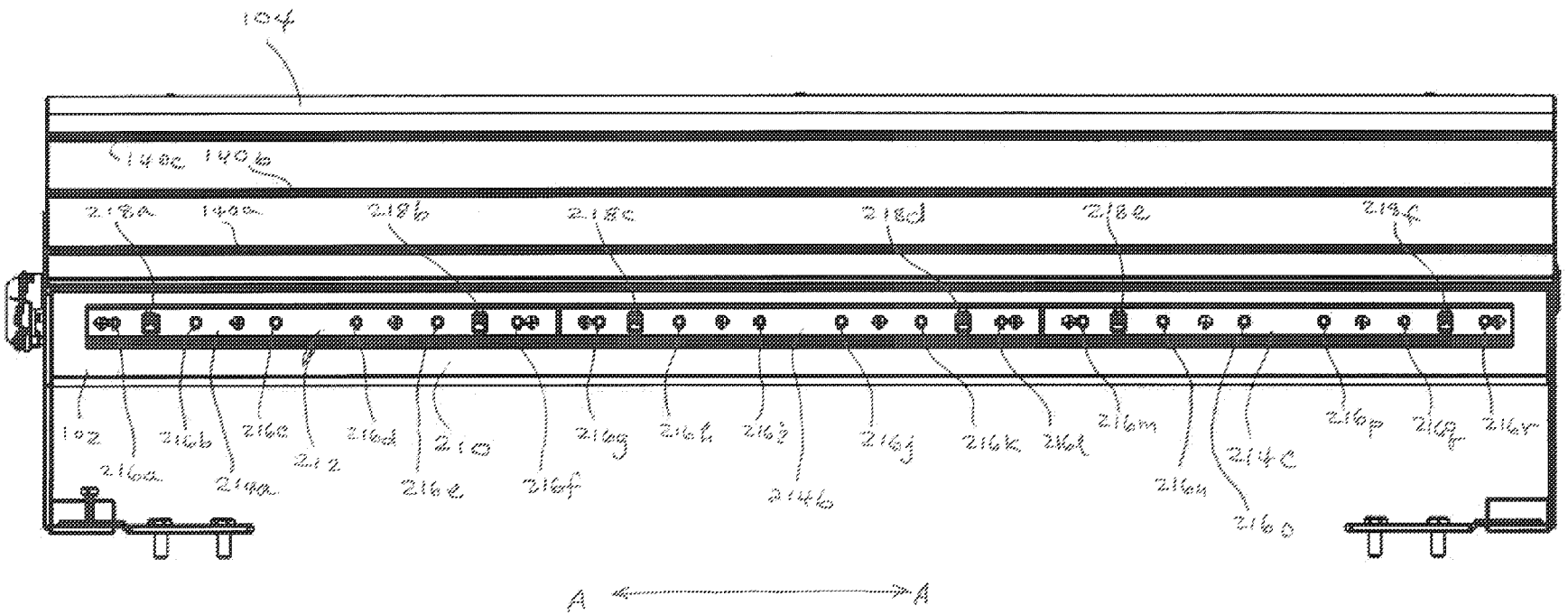
FIG. 4 is a bottom plan view of the lighting device of FIG. 1.
Figure 5:
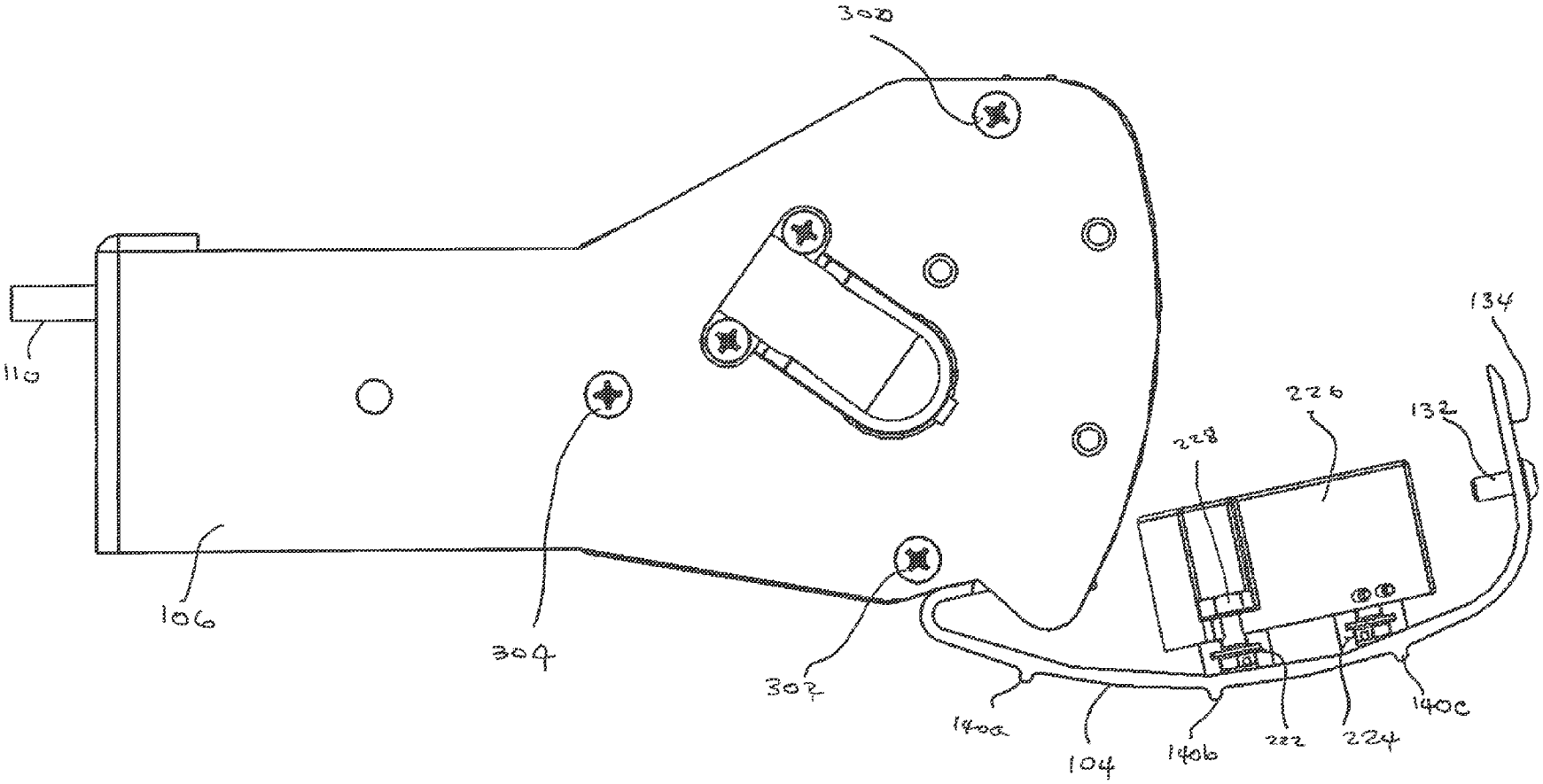
FIG. 5 is a left-side elevational view of the lighting device of FIG. 1.
Figure 6A:
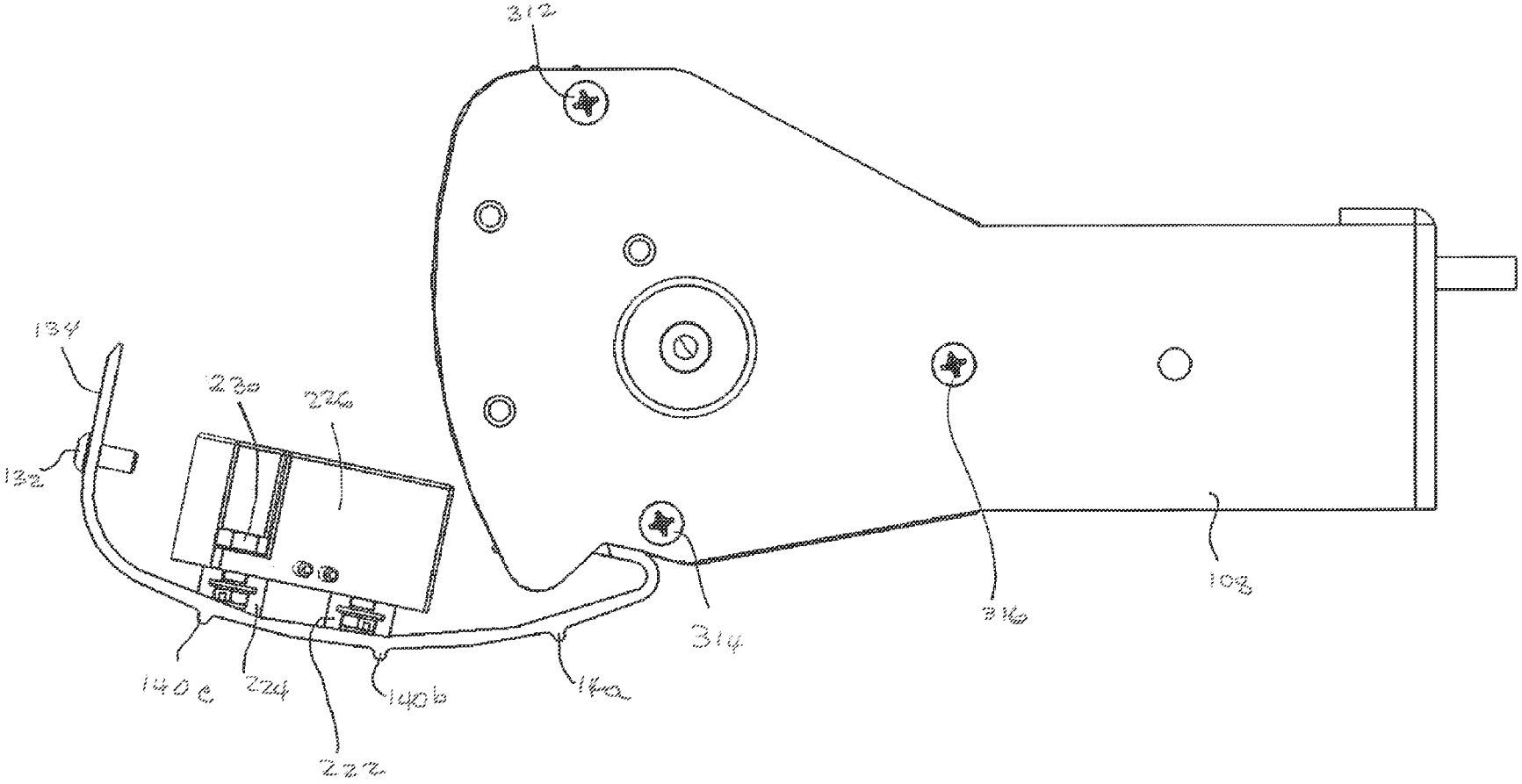
FIG. 6 is a right-side elevational view of the lighting device of FIG. 1.

Referring to FIG. 4, a bottom portion 210 of the body 102 also includes a window 212 disposed therein that partially extends the length of the body 102 in the direction A-A. A second set of circuit boards 214*a*, 214*b*, and 214*c* having LED light sources 216 secured thereto are disposed inside the body 102 such that light emitted by the LED light sources 216 is projected outwardly through the window 212. Each circuit board 214 includes one or more terminal blocks 218 disposed thereon to distribute power from the driver unit 226 to the LED light sources 216 disposed on such board 214. Although FIG. 4 shows three circuit boards 214*a*, 214*b*, and 214*c*, it should be apparent that more or fewer circuit boards 214 may be disposed in the body 102.

Referring also to FIGS. 2, 3, 5, and 6, disposed on an inner surface 220 of the cover 104 are channels 222 and 224 that extend along the direction A-A. Each channel 222 and 224 includes inner walls so that a driver unit 226 may be secured to such channels 222 and 224 with screws 228 and 230. In some embodiments, a bolt and nut may be used to secure the driver wilt 226 to the channels 222 and 224. For example, bolts may be inserted into each of the channels 222 and 224, passed through mounting points in the driver unit 226, and nuts fastened to the bolts to secure the driver unit 226 to the channels 222 and 224. Other ways of the securing the driver unit 226 to the channels 222 and 224 will be apparent to those who have skill in the art. Electrical power supplied from an external power source, for example, through the wire in the conduit coupled to the connector 130, may be directed by wiring (not shown) to the driver unit 226. The driver unit 226 converts the power from alternating current to direct current (if necessary), adjusts the voltage and/or current of the power as necessary, and supplies the converted and/or adjusted power to the terminal blocks 208 and 218. As described above, the terminal blocks 208 and 218 distribute such supplied power to the LED light sources 206 and 216, respectively. It will be apparent to one of skill in the art how to configure a driver unit 226 to convert power from a power source to power provided to the terminal block 208 and 218, and also how to distribute power from the terminal blocks 208 and 218 to the LED light sources 206 and 216, respectively.

Referring to FIGS. 5-8, the left side plate 106 is secured to the body 102 by screws 300, 302, and 304. In particular, the screw 300 secures the left side plate 106 to a threaded channel 306 disposed in the top portion 200 of the body 102. The screw 302 secures the left side plate 106 to a channel 308 disposed in the bottom portion 210 of the body 102. The screw 304 secures the left side plate 106 to a channel 310 disposed in a rear portion 423 of the body 102. In some embodiments, the top portion 200, the bottom portion 210 and the rear portion 423 comprise a contiguous body 102. In some cases, such contiguous body 102 is manufactured as a single extrusion. In other embodiments, the body 102 may comprise separate top, bottom, and rear portions, 200, 210, and 423, respectively, that are joined to one another.

The channels 306, 308, and 310 extend the entire length of the body 102 in the direction A-A. The right side plate 108 is secured to the body 102 by fastening screws 312, 314, and 316 to the channels 306, 308, and 310, respectively.

Figure 7:
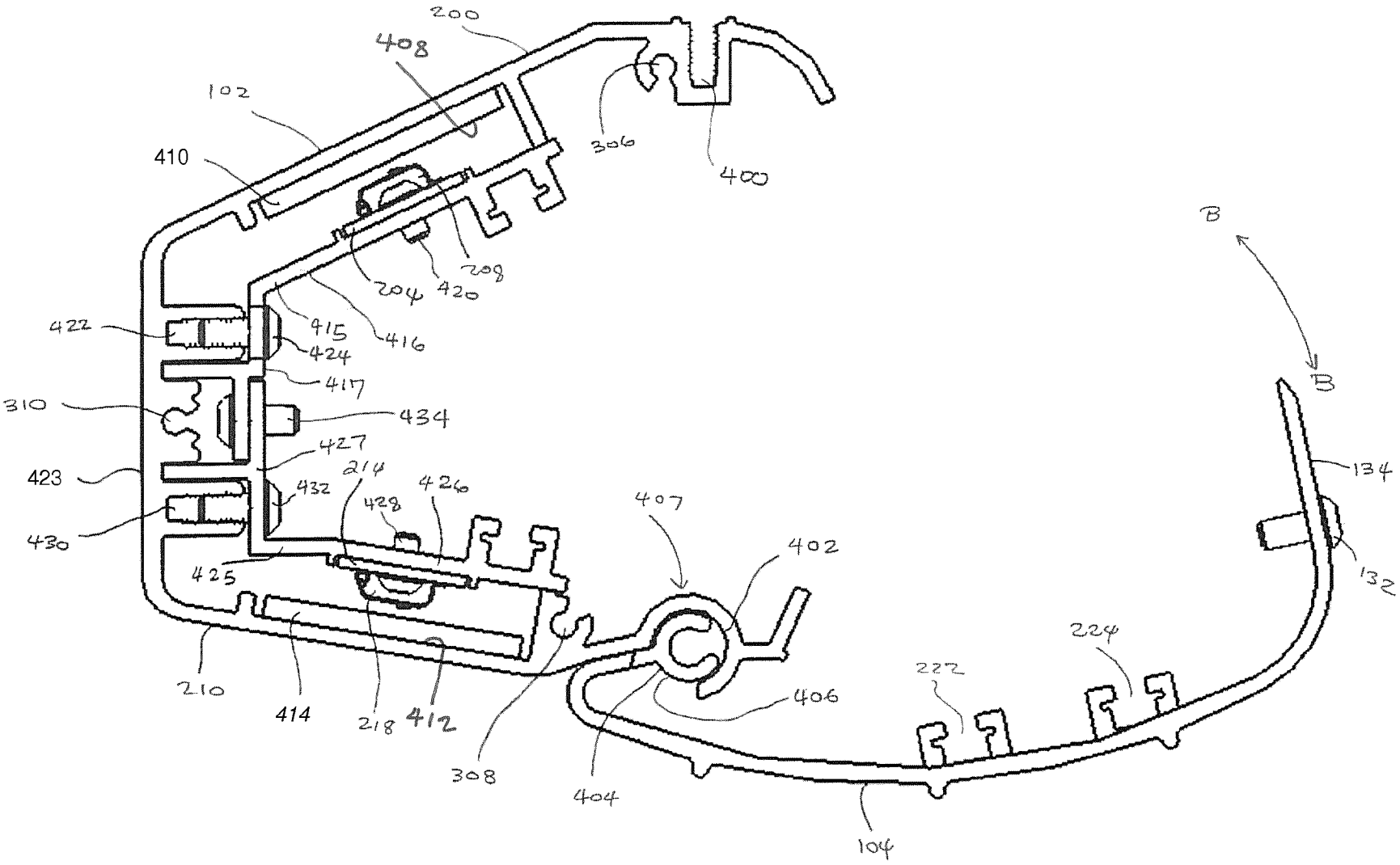
FIG. 7 is a cross-sectional view taken generally along the lines 7-7 of FIG. 2.
Figure 8:
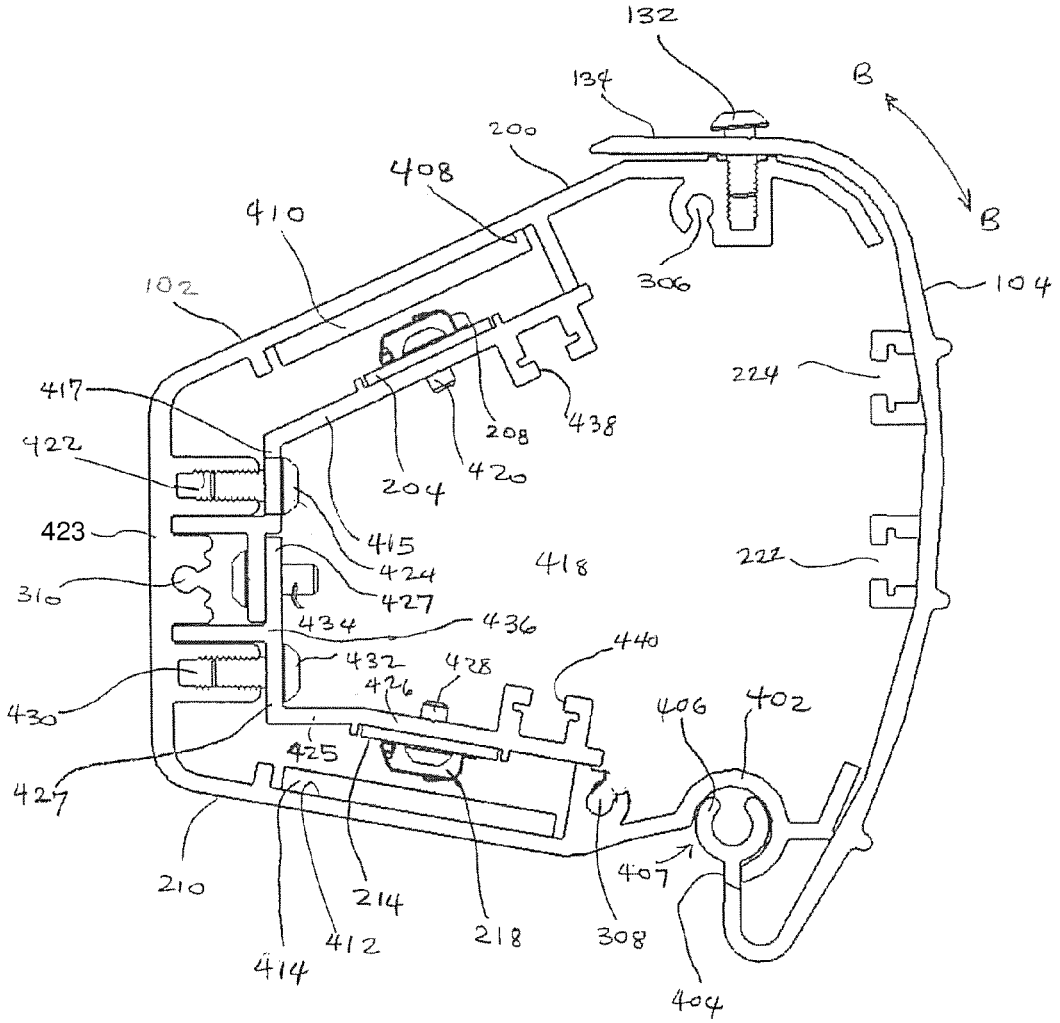
FIG. 8 is a cross-sectional view taken generally along the lines 8-8 of FIG. 1.

Note, the cross-sectional views of FIGS. 7 and 8 omit the driver unit 226 for sake of clarity.

Referring to FIGS. 1, 7 and 8, the top portion 200 of the body 102 includes a threaded channel 400 that extends the length of the body 102 in the direction A-A. The threaded channel 400 provides a receptacle into which the screw 132 may be fastened when the cover 104 is in a closed position.

Disposed in the bottom portion 210 of the body 102 are one or more semi-cylindrical portions 402. In some embodiments, one semi-cylindrical portion 402 extends the length of the body 102 in the direction A-A. In other embodiments, a plurality of semi-cylindrical portions 402 is disposed along the length of the body 102, with gaps therebetween.

Disposed at one end 404 of the cover 104 are one or more semi-cylindrical portions 406. Each such semi-cylindrical portion(s) 406 corresponds to a semi-cylindrical portion 402 disposed in the body 102. The diameter of the semi-cylindrical portion 406 is smaller than the diameter of the semi-cylindrical portion 402 such that the semi-cylindrical portion 406 may be nested inside of the semi-cylindrical portion 402. Nesting the semi-cylindrical portions 402 and 406 in this manner form a hinge 407 that allows the cover 104 to pivot in the direction B-B about the semi-cylindrical portion 406 in the direction B-B. Such pivoting allows the cover 104 to be transported between an open position (as shown in FIG. 7) and a closed position (as shown in FIG. 8).

Disposed on an underside 408 of the top portion 200 of the body 102 is a lens 410 that covers the window 202. The lens 410 is larger than the window 202 and extends beyond the window 202 in the direction A-A and in direction perpendicular thereto. The portions of lens 410 that extend beyond the length and width of the window 202 are secured by an adhesive to the underside 408 of the top portion 200 of the body 102. In one embodiment, a silicone adhesive is used to secure the lens 410 to the underside 408 of the body 102. Other suitable adhesives will be apparent to those who have skill in the art.

Disposed on an underside 412 of the bottom portion 210 of the body 102 is a lens 414. The lens 414 covers the window 212. The width and the length of the lens 414 are larger than the width and the length, respectively, of the window 212. The portions of the lens 414 that extend beyond the window 212 are secured by an adhesive to the underside 412 of the bottom portion 210 of the body 102.

The circuit boards 204 are disposed on a top board holder 415, as shown in FIG. 8. The top board holder 415 includes a holding member 416 and an attachment member 417. The top board holder 415 is disposed in volume 418 formed by the body 102 and cover 104. Each circuit board 204 is secured to the holding member 416 of top board holder 415 by one or more screws 420. Further, the top board holder 415 is disposed such that the LED light sources 206 disposed on the circuit boards 204 are aligned with the lens 410 and the window 202. A threaded channel 422 is disposed on the rear portion 423 of the body 102. The threaded channel 422 extends the length of the body 102 along the direction A-A. The attachment member 417 of the top board holder 415 is secured to the rear portion 423 of the body 102 by threading one or more screws 424 through the top board holder 415 and into the threaded channel 422. In some embodiments, the holding member 416 of the top board holder 415 is substantially parallel to at least a part of the top portion 200 of the body 102. Further, in some cases, the attachment member 417 of the top board holder 415 is substantially parallel to the rear portion 423 of the body 102.

A bottom board holder 425 is also disposed in the volume 418. The bottom board holder 425 includes a holding member 426 and an attachment member 427. Each circuit board 214 is secured to the holding member 426 of the bottom board holder 425 by one or more screws 428. The bottom board holder 425 is disposed such that the LED light sources 216 secured to the circuit board 214 are aligned with the lens 414 and the window 212. A threaded channel 430 is disposed on the rear portion 423 of the body 102 and extends the length of the body 102 in the direction A-A. The attachment portion 427 of the bottom board holder 425 is secured to the rear portion 312 by threading a screw 432 through the bottom board holder 425 and into the channel 430. In some embodiments, the holding member 426 of the bottom board holder 425 is substantially parallel to at least a part of the bottom portion 210 of body 102. In addition, in some cases, the attachment member 427 of the bottom board holder 425 is substantially parallel to the rear portion 423 of the body 102.

A screw 434 secures the attachment member 417 of the top board holder 415 and the attachment member 427 of the bottom board holder 425 to one another. Like the body 102 and the cover 104, the top board holder 415 and the bottom board holder 425 are manufactured by extrusion of a thermally conductive material.

In some embodiments, the top board holder 415 and the bottom board holder 425 are secured to one another to form a unit 436. The attachment portions 417 and 427 of the top board holder 415 and the bottom board holder 425, respectively, combine to form a rear portion 437 of the unit 436. The screws 424 and 432 secure the rear portion 437 of the unit 436 to the rear portion 312 of the body 102. The unit 436 may be detached from the body 102 for maintenance by removing the screws 424 and 432. Such maintenance may include, for example, repair and/or replacement of the circuit boards 204 and 214 disposed on the board holders 415 and 425, respectively. Such maintenance may also include cleaning and or repair areas of the body 102 or the unit 436 that are difficult to access when the unit 436 is secured to the body 102. After the maintenance is completed, the unit 436 may be secured again to the body 102 using the screws 424 and 432. In some cases, the unit 436 may be extruded as a single piece instead of being formed using two discrete pieces and secured to the rear portion 423 by the screws 424 and 432.

Channels 438 and 446 may be disposed in the unit 436 to guide wiring (not shown) from the driver unit 226 to the circuit boards 204 and 214, respectively.

Because the body 102, the cover 104, the top board holder 415 and the bottom board holder 425 are manufactured from thermally conductive material, these components act as heat sinks and heat generated by the LED light sources 206 and 216 and the driver unit 226 is distributed into these components and dissipated to the environment outside the lighting device 100. Similarly, if the lighting device 100 comprises a unit 436 extruded as a single piece, such unit also acts as a heat sink and draws heat generated by the LED light sources 206 and 216 away therefrom and to the exterior of the lighting device 100. Further, because the hinge 407 is disposed at the bottom-front of the body 102, and therefore at the bottom-front of the lighting device 100, the cover 104 opens to provide access to the volume 418 from the front of the lighting device 100. Such access allows an operator to clean the interior volume 418 and replace or otherwise perform maintenance on the components of the lighting device 100.

INDUSTRIAL APPLICABILITY

Numerous modifications to the lighting device will be apparent to those skilled in the art in view of the foregoing description. Accordingly, this description is to be construed as illustrative only and is presented for the purpose of enabling those skilled in the art to make and use the lighting device and to teach the best mode of carrying out same. The exclusive rights to all modifications which come within the scope of the appended claims are reserved.

We claim:

1. A lighting device, comprising:

a body having a top portion, a bottom portion, and a rear portion;

a light source holder having a holding member and an attachment member, the attachment member of the light source holder is secured to the rear portion of the body;

a light source, wherein the light source is disposed on the holding member of the light source holder;

a cover having one end pivotably attached to the body;

a lens separate from the cover and secured to the body, wherein light emitted by the light source passes through the lens; and a driver unit for controlling the light source, wherein the driver unit is secured to the cover and the cover conducts heat generated by the driver unit to the body.

2. The lighting device of claim 1, wherein the light source holder is disposed such that the holding member is parallel to a portion of one of the top portion or the bottom portion of the body.

3. The lighting device of claim 1, further comprising a second light source, and a second light source holder having a holding member and an attachment member, wherein the second light source is disposed on the holding member of the second light source holder and the second light source holder is secured to the rear portion of the body.

4. The lighting device of claim 3, wherein the light source holder and the second light source holder are coupled to one another to form a unit.

5. The lighting device of claim 4, wherein the unit may by inserted and removed from the body without decoupling the light source holder and the second light source holder.

6. The lighting device of claim 1, further comprising a window disposed on a portion of the body, and the light source holder is disposed such that the light source is aligned with the window.

7. The lighting device of claim 6, further comprising a second window disposed on a second portion of the body, a second light source, and a second light source holder, wherein the second light source is disposed on the second light source holder and the second light source holder is disposed such that the second light source is aligned with the second window.

8. The lighting device of claim 1, wherein the one end of the cover is pivotally attached to the bottom portion of the body.

9. The lighting device of claim 8, wherein another end of the cover is adapted to be fixedly attached to the top portion of the body.

10. The lighting device of claim 1, wherein the lens is non-pivotably attached to the body.

11. The lighting device of claim 8, wherein the cover and the body define an interior volume of the lighting device.

12. The lighting device of claim 8, wherein the light source holder is disposed in the interior volume.

13. The lighting device of claim 1, wherein the light source comprises a plurality of light emitting diodes disposed on a circuit board.

14. The lighting device of claim 1, wherein the holding member of the light source holder is substantially parallel to a portion of the top portion of the body.

15. The lighting device of claim 14, comprising a holding unit, wherein the light source holder forms a first portion of the holding unit and the holding unit includes a second portion that is substantially parallel to the bottom portion of the body.

16. The lighting device of claim 1, wherein the holding member of the light source holder is substantially parallel to a portion of the bottom portion of the body.

17. The lighting device of claim 1, wherein the attachment member of the light source holder is substantially parallel to the rear portion of the body.

18. The lighting device of claim 1, wherein the light source holder comprises a thermally conductive material.

19. The lighting device of claim 18, wherein the thermally conductive material conducts thermal energy away from the light source.

20. A lighting device, comprising:

a body having a top portion and a bottom portion;

a cover having a first end and a second end, wherein the cover is pivotably movable between an open position and a closed position;

a lens separate from the cover and secured to the body;

a light source, wherein light emitted by the light source passes through the lens;

a driver unit for controlling the light source, wherein the driver unit is secured to the cover and the cover conducts heat generated by the driver unit to the body; and wherein the first end of the cover is pivotably secured to the body and the second end of the cover is adapted to be fixedly secured to the body.

21. The lighting device of claim 20, wherein at least one of the body and the cover is manufactured from a thermally conductive material.

22. The lighting device of claim 20, wherein the light source comprises a first set of light sources positioned to direct light outwardly from the top portion of the body.

23. The lighting device of claim 22, further comprising a second set of light sources positioned to direct light outwardly from the bottom portion of the body.

24. The lighting device claim 23, further comprising a holding unit having a first light source holder and a second light source holder, wherein the first set of light sources is secured to the first light source holder, the second of set of light sources is secured to the second light source holder, and the first light source holder is substantially parallel to the top portion of the body.

25. The lighting device of claim 24, wherein the second light source holder is substantially parallel to the bottom portion of the body.

26. The lighting device of claim 23, wherein the first set of light sources and second set of light sources are enclosed by the cover and the body.

27. The lighting device of claim 22, wherein the lens is non-pivotably secured to the body.

28. The lighting device of claim 22, wherein the first set of light sources comprises a light-emitting diode.

29. The lighting device of claim 20, wherein the second end of the cover is fixedly secured to the top portion of the body.

30. The lighting device of claim 20, wherein the cover is pivotably secured to the body by a hinge formed by the body and the cover.

31. The lighting device of claim 30, wherein the hinge comprises a semi-cylindrical portion of the body.

32. The lighting device of claim 31, wherein the hinge further comprises a semi-cylindrical portion of the cover.

33. The lighting device of claim 32, wherein the hinge is formed by nesting the semi-cylindrical portion of the cover inside the semi-cylindrical portion of the body.

34. A lighting device, comprising:

a body having a top portion, a bottom portion, and a rear portion;

a cover coupled to the body, wherein one end of the cover is pivotally pivotably attached to the body;

a thermally conductive light source holder coupled to the body;

a lens separate from the cover and secured to the body;

a light source disposed on the thermally conductive light source holder, wherein the thermally conductive light source holder conducts heat generated by the light source to the body and the cover, and light emitted by the light source passes through the lens; and a driver unit for controlling the light source, wherein the driver unit is secured to the cover and the cover conducts heat generated by the driver unit to the body.

35. The lighting device of claim 34, wherein the body and the cover dissipate heat conducted thereto to an environment where the lighting device is disposed.

36. The lighting device of claim 34, comprising a second thermally conductive light source holder secured to the rear portion of the body.

37. The lighting device of claim 36, wherein the thermally conductive light source holder conducts heat generated by the light source to the second thermally conductive light source holder.

38. The lighting device of claim 36, comprising a second light source disposed on the second thermally conductive light source holder, wherein the second thermally conductive light source holder conducts heat generated by the second light source to the body and the cover.

39. The lighting device of claim 34, wherein a second light source is disposed on the thermally conductive light source holder.

40. The lighting device of claim 34, wherein the lens is non-pivotably secured to the body.

41. The lighting device of claim 34, wherein the cover is adapted to be secured to the top portion of the body.

42. The lighting device of claim 41, wherein the cover is pivotably secured to the bottom portion of the body.

43. The lighting device of claim 34, comprising a side plate coupled to the body and the cover, wherein heat generated by the light source is conducted to the side plate.

44. The lighting device of claim 43, comprising a second side plate couple to the body and the cover, wherein heat generated by the light source is conducted to the second side plate.

* * * * *